United States Patent [19]

Sechel et al.

[11] Patent Number: 4,751,892

[45] Date of Patent: Jun. 21, 1988

[54] MARINE STANDOFF

[76] Inventors: Daniel Sechel, 4812 Daylon Ct., Vermilion, Ohio 44089; Dennis DeTillio, 1601 Narragansett Blvd., Lorain, Ohio 44053; Alan Szucs, 6401 Baldwin Blvd., Amherst, Ohio 44001

[21] Appl. No.: 66,703

[22] Filed: Jun. 26, 1987

[51] Int. Cl.[4] ..... B63B 9/00

[52] U.S. Cl. ..... 114/221 R; 114/230; 294/19.1; 294/82.19

[58] Field of Search ..... 114/230, 221 R; 294/19.1, 19.2, 19.3, 82.19, 82.17, 82.2, 82.33

[56] References Cited

U.S. PATENT DOCUMENTS

| | | | |
|---|---|---|---|
| 3,177,838 | 4/1965 | Grimes | 114/230 |
| 3,591,226 | 7/1971 | Elmore, Jr. | 294/19.1 |
| 3,913,515 | 10/1975 | Hernsjo et al. | 114/230 |
| 4,195,872 | 4/1980 | Skaalen et al. | 294/82.19 |
| 4,250,827 | 2/1981 | Booker et al. | 114/230 |
| 4,261,279 | 4/1981 | Johnson | 114/220 |

*Primary Examiner*—Sherman D. Basinger
*Assistant Examiner*—Jesús D. Sotelo
*Attorney, Agent, or Firm*—Gustalo Nunez

[57] ABSTRACT

A marine standoff that maintains a watercraft at a fixed distance from a dock or wharf. The marine standoff may be used as a portable unit and stored on board the watercraft or may be used as a fixed unit and left permanently attached to a fixed mooring point. A preferred embodiment includes an attaching hook/clip combination on one end of the marine standoff and an elastomer tip at the other end of the marine standoff through which a line is passed through at the elastomer tip end. A stainless steel cable is attached to the safety clip portion of the hook, said cable being housed within the interior chamber of the marine standoff. The cable end which is remote from the hook is connected to an exterior pull ring which allows the remote release of the safety clip for easy removal of the standoff from a docking device such as a cleat or ring.

2 Claims, 4 Drawing Sheets

MARINE STANDOFF

BACKGROUND OF THE INVENTION

In many situations it is necessary or desirable to moor watercraft to permanently set docks or to floating docks. Regardless of the type of mooring dock used, the water may be rough or the wind may be excessive to the point where it tends to move the watercraft vertically and horizontally. In such situations, the watercraft could be damaged in the event the wrong kind of mooring device is used. The purpose of the instant invention is to provide a marine standoff bar which will permit movement of the watercraft, but which will prevent the watercraft from making contact with the mooring dock. This prevents damage to the watercraft.

Currently there are other types of docking/mooring devices which range from fiberglass poles permanently affixed to docks or piers, to stainless steel expandable posts that are spring retained to hold watercraft off and away from docks and piers and to which the watercraft may be tied. The novelty and uniqueness of the present invention is its adaptability to be used either as a permanent docking device or as a portable docking device which may be stored aboard the watercraft and which, therefore, may be used wherever the watercraft is located. Also, the mooring device can be locked onto a docking ring or cleat very easily and may be removed very easily. The release mechanism is remotely controlled, which increases the distance at which the mooring device can be used.

As was previously mentioned, there are other types of mooring devices taught in the literature, one such example being U.S. Pat. No. 4,250,827 to Booker. The Booker invention provides a boat mooring device which works on a push and pull principal through the use of mooring arms with high flexibility as to directional stress, which exits at the anchor point on the dock as well as at the attachment to the docking fittings located on the boat. The mooring arm in Booker includes an outwardly extending arm comprised of telescopic sections for extendibility and which also includes an elbow joint in the form of a coil spring which connects the telescopic arm to a docking fitting on the dock for allowing flexing movement. In Booker, the telescopic arm sections also act as shock absorber means.

Johnson, in U.S. Pat. No. 4,261,279, teaches a boat connecting device which functions as a fender capable of absorbing kinetic energy which thus protects the boat from incurring damage which may be caused by the boat colliding with the mooring dock. The Johnson device is a thrust rod having two ends, and including means for connecting one end of the thrust rod to the boat and the other end to the dock. The docking end of the thrust rod is linked to one end of each of two elastic shock absorber elements which function to absorb the kinetic energy.

Another type of mooring device is disclosed by Hernsjo, et al., U.S. Pat. No. 3,913,515. Looking at FIG. 1, Hernsjo, et al, illustrates a structure which to a slight degree resembles that of the instant invention. However, a review of the disclosure shows that Melander, et al. describes a snap-hook holder and a handle attached to the snap-hook holder for use with boat mooring devices. Hernsjo, et al. provides the handle to the snap-hook holder to afford a greater reach for the person securing the snap-hook to a boat securing device. Upon securing the snap-hook holder, the handle is removed.

The prior art, as understood, does not operate in the manner that the instant invention functions. The prior art discloses structures which are complex, cumbersome and expensive to manufacture.

SUMMARY OF THE INVENTION

It is an object of the present invention to provide a permanent or portable mooring device that will keep a boat at a fixed distance from a mooring dock, whether the dock is of the permanent type or of the floating type, and which will allow movement of the boat in a vertical direction which may be caused by wave action. The device also may be used in attaching one boat to another, commonly referred to rafting-off. The mooring device includes an attaching hook and clip combination commonly referred to as a snap-hook, in which the locking arm of the snap-hook is biased in a direction towards the open end of the hook. The snap-hook is secured to a tubular handle with the handle end remote from the snap-hook terminating in a closed elastomer type of material. This end is provided with a line which is used to tie the other end of the morring device.

A stainless steel cable is connected at one end to the locking arm of the snap-hook, the cable end remote from the snap-hook is passed through the interior chamber of the tubular handle. An opening for the cable is provided on the tubular handle at the end proximating the elastomer covered end. The cable exits the interior chamber where it is connected to a pull ring which permits the unlocking of the locking arm. This design not only provides greater reach for the user but also provides means for the remote release of the locking arm, which allows the easy removal of the snap-hook.

Keeping in mind the foregoing (which will be evident from an understanding of the disclosure), the instant invention (which in the preferred embodiment comprises a snap-hook with handle means and remote control means for the snap-hook locking means) is hereinafter set forth in such detail as to enable those skilled in the art to readily understand the function, operation, construction and advantages of the invention when read in conjunction with the accompanying drawings. It is to be understood that these drawings are for the purpose of example only, and that the invention is not limited thereto.

DESCRIPTION OF THE PREFERRED EMBODIMENT

Figure 1:
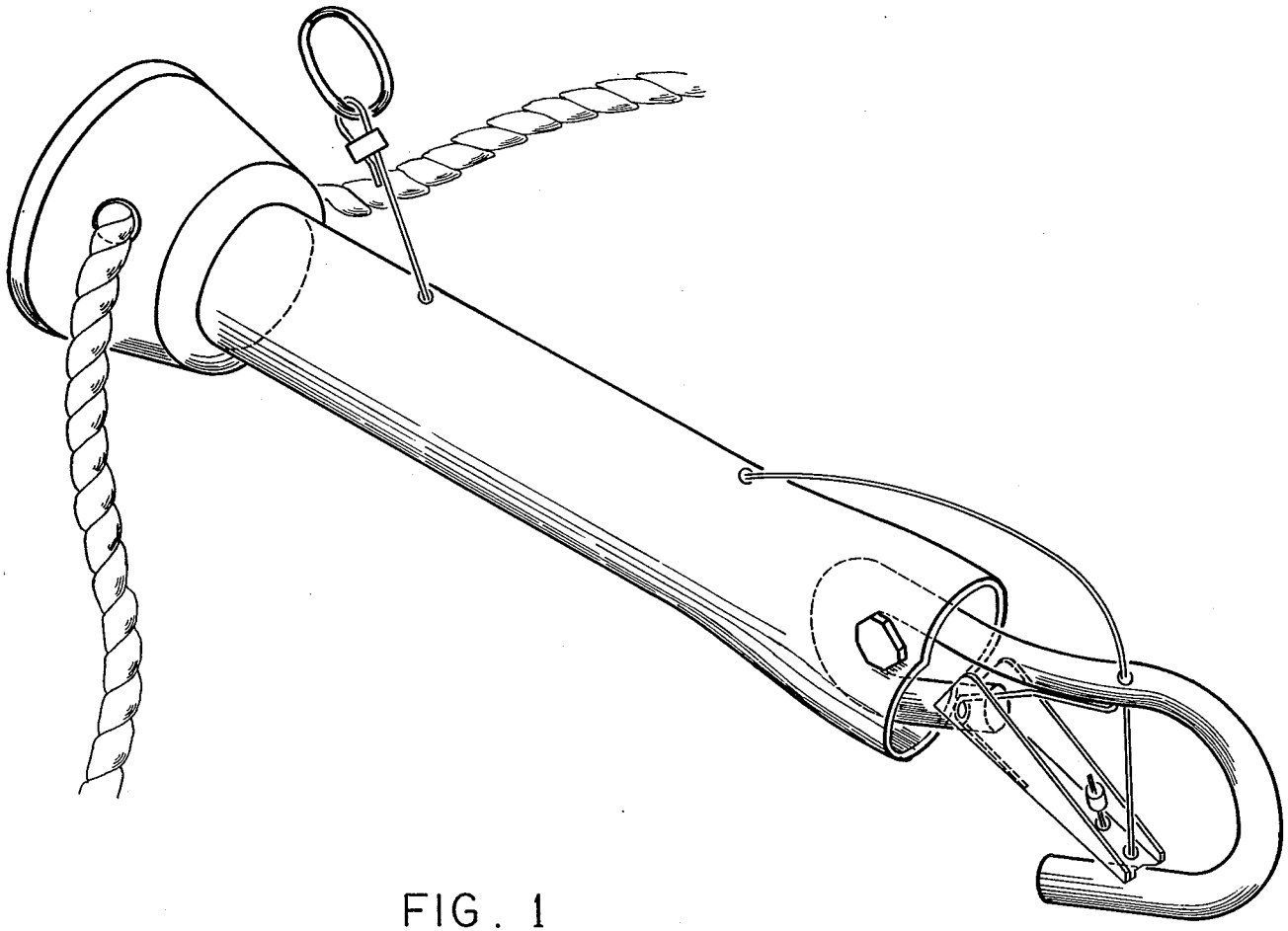
FIG. 1 is a perspective view of the mooring device.
Figure 2:
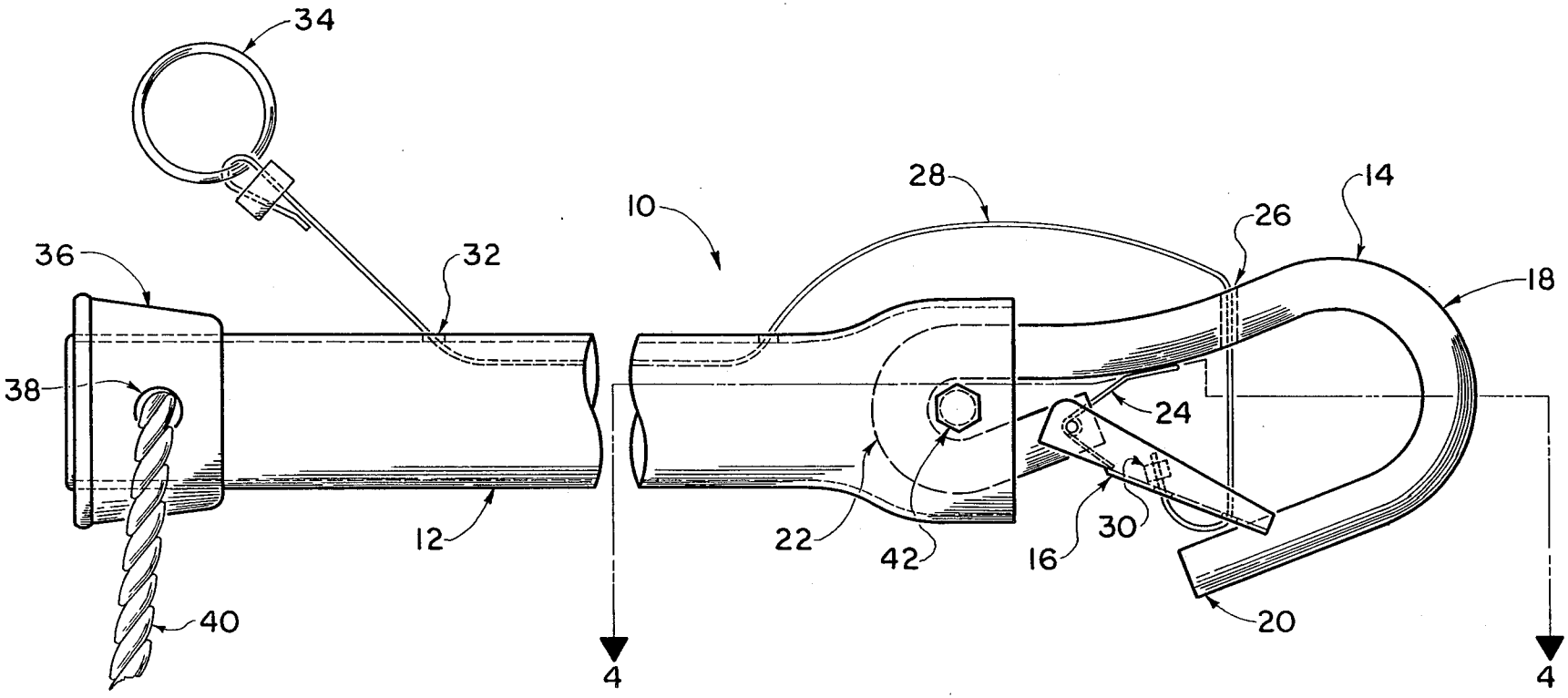
FIG. 2 is a plan view partially in section of the mooring device.
Figure 3:
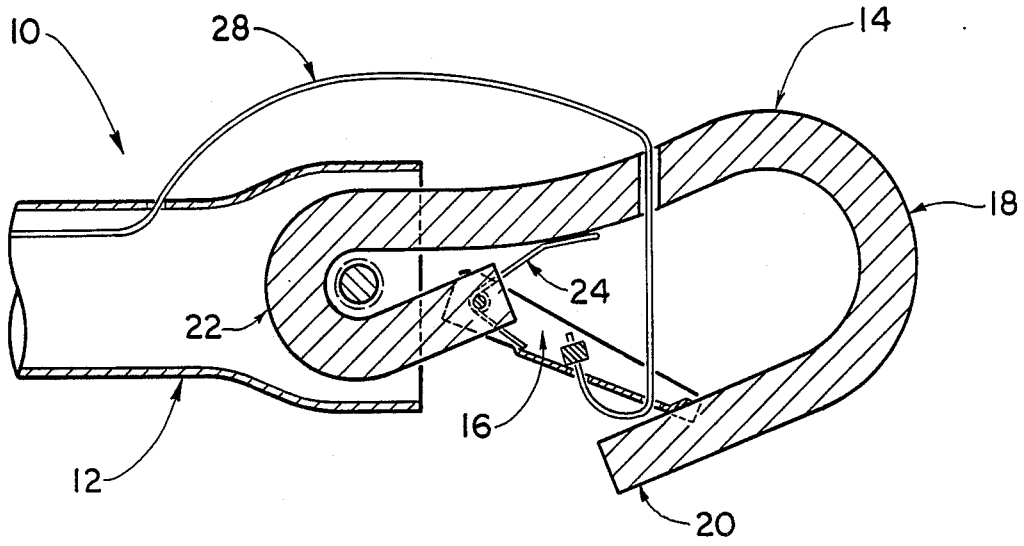
FIG. 3 is a side sectional view of the mooring device.
Figure 4:
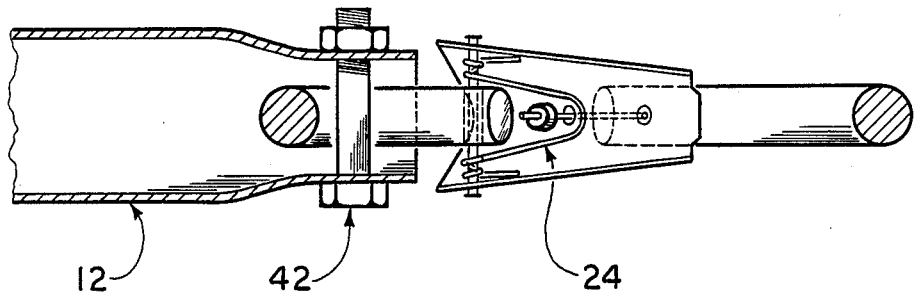
FIG. 4 is a view of the snap-hook device taken along lines 4—4 of FIG. 2.
Figure 5:
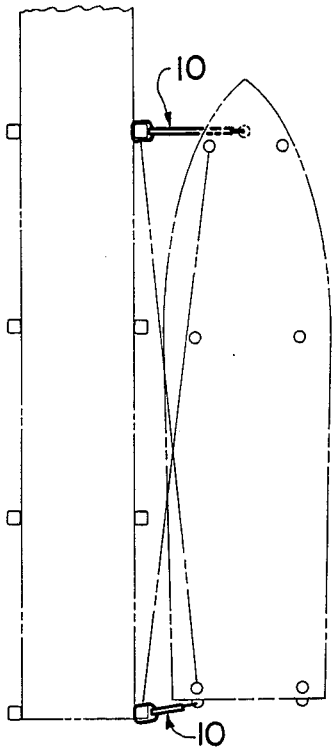
FIG. 5 is a plan view of the mooring device in operative relationship to a boat and dock.

Referring to the drawings, that embodiment of the boat mooring device according to the present invention is indicated generally by the numeral 10. The mooring device 10 has an elongated handle member 12 which in the embodiment shown is a tubular member which can be manufactured from metals or plastic material having the ability to withstand both compression and tension. The length of the handle member 12 may vary depending on the boater's desired use. A snap-hook member 14 is connected at one end of the handle member 12 by well-known connecting means such as a stainless steel bolt 42. The snap-hook 14 is in the shape of a hook having a curved portion 18, a terminating end and another hooked portion 22 which is provided with means for receiving a connecting member 42. Attached to the snap-hook end 22 is a locking arm 16 which is spring biased by spring member 24 in a direction forcing the locking arm 16 into the snap-hook end 20. The snap-hook member 14 is provided with a bore 26 for receiving a cable 28 therethrough. Cable 28 is connected to the locking arm 16 at 30. The cable 28 is passed through the interior chamber formed by the handle member 12. A bore 32 is provided on the handle member 12 for receiving the other end of the cable 28, the cable 28 thus is directed out of the interior chamber of the handle member 12. A pullring 34 is attached to the exiting end of cable 28.

The end of handle member 12 remote from the snap-hook 14 is terminated in an elastomer end tip 36 which is provided with a pair of bores 38 for accommodating a line 40 which is passed through the bores 38.

Figure 6:
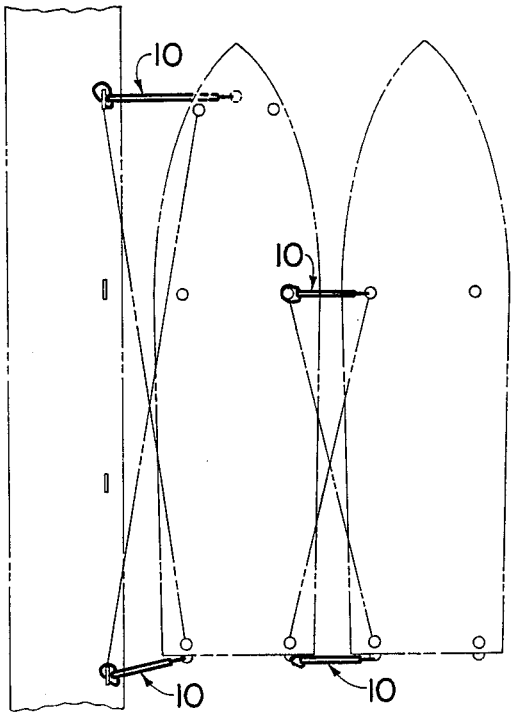
FIG. 6 is a plan view of the mooring device used in a rafting-off mode.

The mooring device described above was designed to fill a need for a device that would keep a boat at a fixed distance from a dock, pier or any type of mooring for a boat. It was also designed for use in rafting-off with another boat. In operation when docking, mooring or rafting-off, the mooring device 10 is hooked onto the bow ring of the boat and the terminating end provided with the elastomer tip 36 and line 40 is tied to a fixed fastening point such as a dock pole, dock cleat, boat cleat or the bow ring of another boat. Another mooring device 10 would attach to a stern cleat in the same manner. This method of attachment prevents the boat from moving towards or away from the docking point. In addition to the mooring device 10, spring lines may be attached to the boat (FIG. 6) to prevent the boat from moving forward or backward. The mooring device 10 is best used in pairs, i.e. one for the bow and one for the stern. The user of the mooring device 10, when he wants to be disconnected from the dock, merely has to pull on the pullring 34 which opens the locking arm 16, which allows the user to disengage the snap-hook member 14 from the bow ring, cleat or the like. Thus, it can be seen that the mooring device 10 described herein allows for the remote release of the snap-hook member 14.

It has been found that the best material to use for the mooring device 10 is seamless aluminum tubing which is anodized. The snap-hook member 14 is formed of plated steel which is connected to the handle member 12 by a stainless steel bolt and nut at 42.

While a preferred embodiment has been disclosed, it will be apparent to those of ordinary skill in the art, upon reading this disclosure, that other modifications and variations can be made. Accordingly, reference should be made to the appended claims for determining the full and complete scope of the present invention.

What is claimed is:

1. A mooring device for boats comprising:

an elongated tubular handle member having first and second terminating ends, said first terminating end affixed to a snap-hook member, said second terminating end provided with an elastomer tip and with at least a pair of bores through said elastomer tip and said second terminating end for receiving a line member, said snap-hook member further including a spring biased locking arm, said spring biased locking arm biased in a direction toward the open portion of said snap-hook member, operative means passing through an interior chamber described by said elongated tubular handle member and in which said operative means exits the interior chamber at a point remote from the snap-hook member connected to said locking arm for providing for the remote operation of said locking arm, said snap-hook member designed to be connected to a cleat member at one end and said elastomer tip end connected to a docking point, said operative means used to open said locking arm for the disengagement of said snap-hook member from a cleat member.

2. A mooring device for watercraft comprising:

an elongate cylindrical handle member having first and second terminating ends, said first terminating end affixed to a snap-hook member, said second terminating end provided with a line member, said snap-hook member further including a spring biased locking arm member, said locking arm member biased in a direction toward the open portion of said snap-hook member, a cable at one end thereof, connected to said spring biased locking arm member and said cable passing through and out of an interior chamber formed by said cylindrical handle member, said cable exiting said interior chamber at a point remote from said snap-hook member, said cable connected to a ring member at the remote end thereof, said snap-hook member designed to be connected to a cleat member at one end, and said other end connected to a docking member with said line member, said cable, when pulled, operating said locking member into an open position for the disengagement of said snap-hook member from a cleat member.

* * * * *